US009966172B2

(12) United States Patent
Edgley et al.

(10) Patent No.: US 9,966,172 B2
(45) Date of Patent: May 8, 2018

(54) ACTUATION ARRANGEMENT

(71) Applicant: Siemens Healthcare Limited, Camberley (GB)

(72) Inventors: Paul William Edgley, Bampton (GB); Neil Charles Tigwell, Witney (GB)

(73) Assignee: Siemens Healthcare Limited, Camberley (GB)

( * ) Notice: Subject to any disclaimer, the term of this patent is extended or adjusted under 35 U.S.C. 154(b) by 0 days. days.

(21) Appl. No.: 15/147,354

(22) Filed: May 5, 2016

(65) Prior Publication Data

US 2016/0327139 A1 Nov. 10, 2016

(30) Foreign Application Priority Data

May 6, 2015 (GB) ..... 1507737.3

(51) Int. Cl.

| | |
|---|---|
| ***F17C 3/08*** | (2006.01) |
| ***H01F 6/04*** | (2006.01) |
| ***F17C 13/00*** | (2006.01) |

(52) U.S. Cl.
CPC ..... *H01F 6/04* (2013.01); *F17C 3/08* (2013.01); *F17C 13/00* (2013.01)

(58) Field of Classification Search
CPC ..... F17C 13/00; F17C 3/08; H01F 6/04
See application file for complete search history.

(56) References Cited

U.S. PATENT DOCUMENTS

| | | | |
|---|---|---|---|
| 7,750,539 | B2 | 7/2010 | Dollgast et al. |
| 2015/0075312 | A1 | 3/2015 | Boning et al. |

FOREIGN PATENT DOCUMENTS

| | | | |
|---|---|---|---|
| CN | 204224162 | U | 3/2015 |
| JP | S62198106 | A | 9/1987 |
| RU | 2 013 684 | C1 | 5/1994 |

*Primary Examiner* — Victor L Macarthur
(74) *Attorney, Agent, or Firm* — Schiff Hardin LLP

(57) ABSTRACT

A mechanical actuation arrangement for remotely applying a force to a cryogenically-cooled device has a mechanical actuator composed of multiple parts. In use, the parts bear against one another to enable a force to be applied to the device by an actuator device, and when not in use, the parts separate.

13 Claims, 4 Drawing Sheets

ACTUATION ARRANGEMENT

BACKGROUND OF THE INVENTION

Field of the Invention

The present invention relates to arrangements for remote actuation of devices in a cryogenic environment. In particular, the present invention provides arrangement for actuation at room temperature of a mechanical or electromechanical device which is at a cryogenic temperature, which has a limited thermal conductivity between the room temperature actuator and the electromechanical device at cryogenic temperature.

The present invention will be particularly described with reference to an application to superconducting magnets retained within a cryostat, but may be applied to other systems, as will be apparent to those skilled in the art.

Description of the Prior Art

In cryogenically cooled systems, such as superconducting magnet systems, it is frequently required to apply an actuation force to a variety of devices such as thermal links, electrical switches, other electrical devices.

Conventionally, such actuation forces have been applied by numerous arrangements such as electrical drives, gas pressure in expanding bellows, pistons or the like, or mechanically through an access port such as a neck tube in a cryogen vessel.

SUMMARY OF THE INVENTION

The present invention provides an alternative to these existing arrangements for applying actuation forces, which employs mechanical actuation without introducing an excessive thermal conduction into the cryogenic environment.

DESCRIPTION OF THE PREFERRED EMBODIMENTS

The present invention will be particularly described with reference to a cryostat comprising an inner, cryogen cooled vessel, tank or pipework or similar contained within an outer vacuum container (OVC), with a thermal radiation shield placed within the OVC, shielding the cryogen cooled component from radiant heat from the OVC, which is typically itself at ambient temperature.

Figure 1:
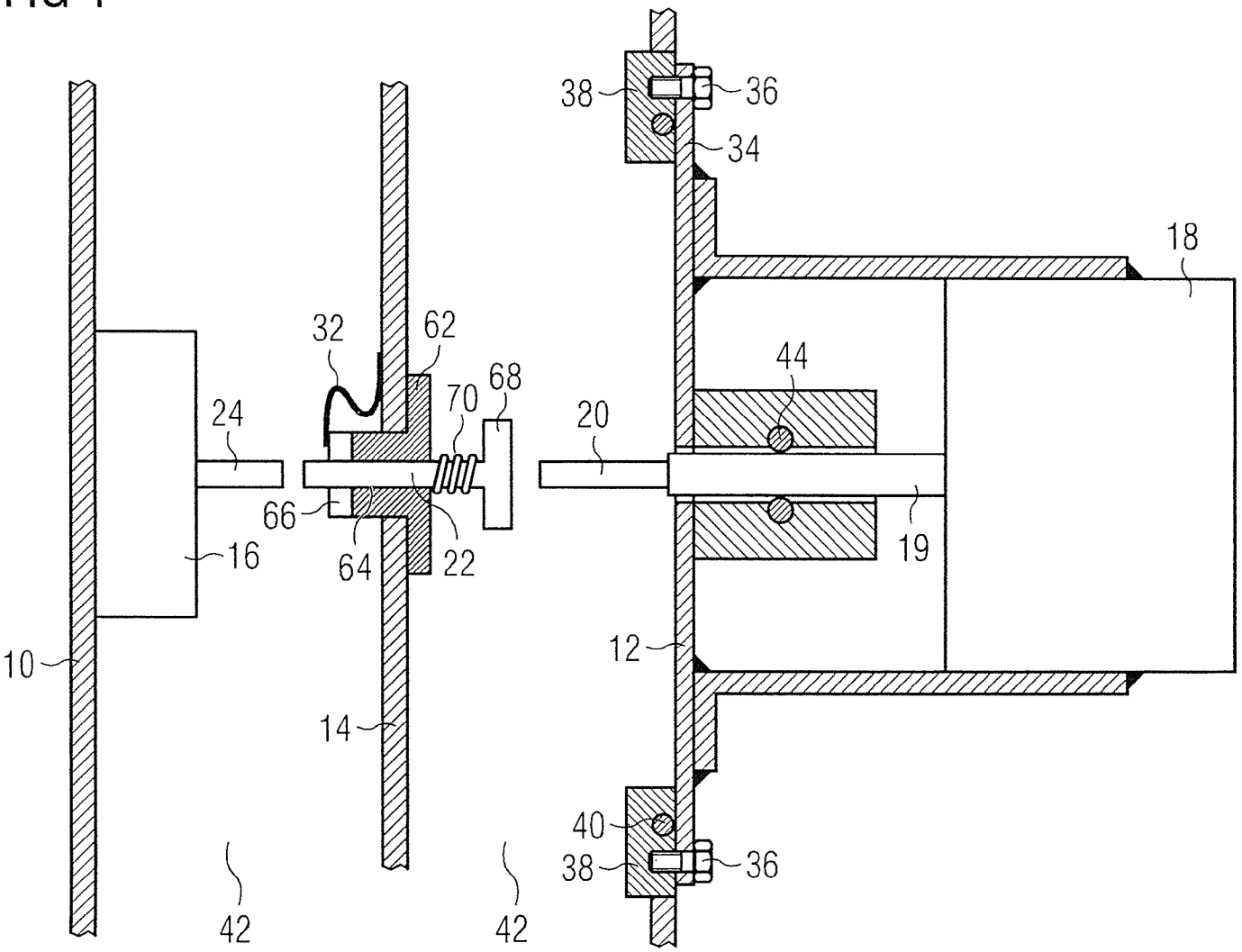
FIG. 1 schematically illustrates an embodiment of the present invention in a first state.

FIG. 1 schematically illustrates an embodiment of the present invention. The drawing represents a fragment of a cryostat wall, comprising a cryogen vessel 10 within an outer vacuum container OVC 12, with a thermal radiation shield 14 located between them, shielding the cryogen vessel 10 from radiant heat emitted by the OVC 12. The cryogen vessel 10, OVC 12 and thermal radiation shield 14 are all retained in respective positions by mechanical retention means, not shown, and other apparatus, such as a cryogenic refrigerator and/or volume of liquid cryogen, is provided, as will be apparent to those skilled in the art.

According to this embodiment of the invention, a device 16 to be actuated is attached to the cryogen vessel 10, either on its outer surface as shown in FIG. 1, or on its inner surface, as will be discussed in more detail below, in the context of a further embodiment of the present invention. An actuator device 18 is mounted to an external surface of the OVC. Actuator device 18 comprises an output tube 19 and serves to drive a first push-rod 20 through the output tube 19 inwards or outwards of the OVC, towards or away from the device 16. Actuator device 18 may itself be electrically, pneumatically, hydraulically or manually mechanically operated.

A second push-rod 22 traverses the radiation shield 14 through a hole 30. A thermal intercept 32 may be provided to ensure that the second push-rod 22 is cooled to the temperature of the thermal radiation shield 14. The second push-rod is supported and mechanically biased to the illustrated rest position.

Second push-rod 22 is mounted to the thermal radiation shield 14. The mounting arrangement should provide thermal connection between second push-rod 22 and thermal radiation shield 14, should block thermal radiation from OVC 12 to cryogen vessel 10 and should urge the second push-rod 22 into a defined rest position. In the illustrated embodiment, second push-rod 22 passes through a guide bushing 62, which may be a plastic moulding. The plastic moulding may be loaded with metal or carbon powder to increase its thermal conductivity. Guide bushing 62 comprises a bore 64 for passage of the second push-rod 22 therethrough, and otherwise covers hole 30 in the thermal radiation shield 14. The guide bushing 62 is mechanically mounted onto the thermal radiation shield and provides mechanical support to the second push-rod 22. A collar, enlarged head or similar protrusion 66 provided on the second push-rod near an end nearest device 16 retains the second push-rod 22 in the guide bushing 62 and may serve to close any radiation path through the bore 64 between the second push-rod 22 and the guide bushing 62. Preferably, as illustrated, the collar 66 is thermally linked to the thermal radiation shield 14 by a thermally conductive braid, laminate or other flexible, thermally conductive path 32. A second collar, enlarged head or similar protrusion 68 provided on the second push-rod near an end furthest from device 16 retains the second push-rod 22 in the guide bushing 62. A spring 70 or equivalent resilient member bears between second collar, enlarged head or similar protrusion 68 and the guide bushing 62 or thermal radiation shield 14. The combination of spring 70 and first and second collar, enlarged head or similar protrusion 66, 68 operate to bias the second push-rod to a rest position in its range of travel at a location furthest from device 16. Other equivalent mounting arrangements may be provided, but preferably provide the functions of mechanically mounting and restraining the second push-rod while biasing it to a defined rest position and providing thermal conductivity between second push-rod 22 and thermal radiation shield 22.

Device 16 is, in this embodiment, mounted on an outside surface of the cryogen vessel 10. An actuator rod 24 is provided. In operation, the actuator rod 24 must be actuated by mechanical pressure from actuator device 18. Actuator rod 24 may have a form similar to that of first- and/or second-push-rods 20, 22. According to its type, the device 16 will change status in response to pressure applied to the actuator rod 24.

Actuator device 18 may be mounted onto an access hatch 34 which is demountable for ease of servicing, removal or replacement of the arrangement of the present invention, or any component of it. Such access hatch 34 may be attached to the rest of the OVC 12 by removable fasteners 36 such as bolts screwed into blind threaded holes 38. A seal 40 such as a polymer gasket may be provided to prevent influx of air into the vacuum region 42.

Output tube 19 may be sealed 44, for example with a polymer gasket, to prevent air influx at the interface between first push-rod 20 and the access hatch 34 or OVC 12. In an alternative arrangement, seal 44 may bear upon the first push-rod 20. In such case, output tube 19 may be omitted.

FIG. 1 shows the arrangement of this embodiment of the invention in "rest" mode. The actuator device 18 causes the first push-rod 20 to displace away from device 16, outwards from the OVC. Contact between the first push-rod 20, second push-rod 22 and actuator rod 24 is broken. No force is being applied to actuator rod 24 and second push-rod 22 is displaced to its rest position, out of contact with both the first push-rod 20 and the actuator rod 24.

Figure 2:
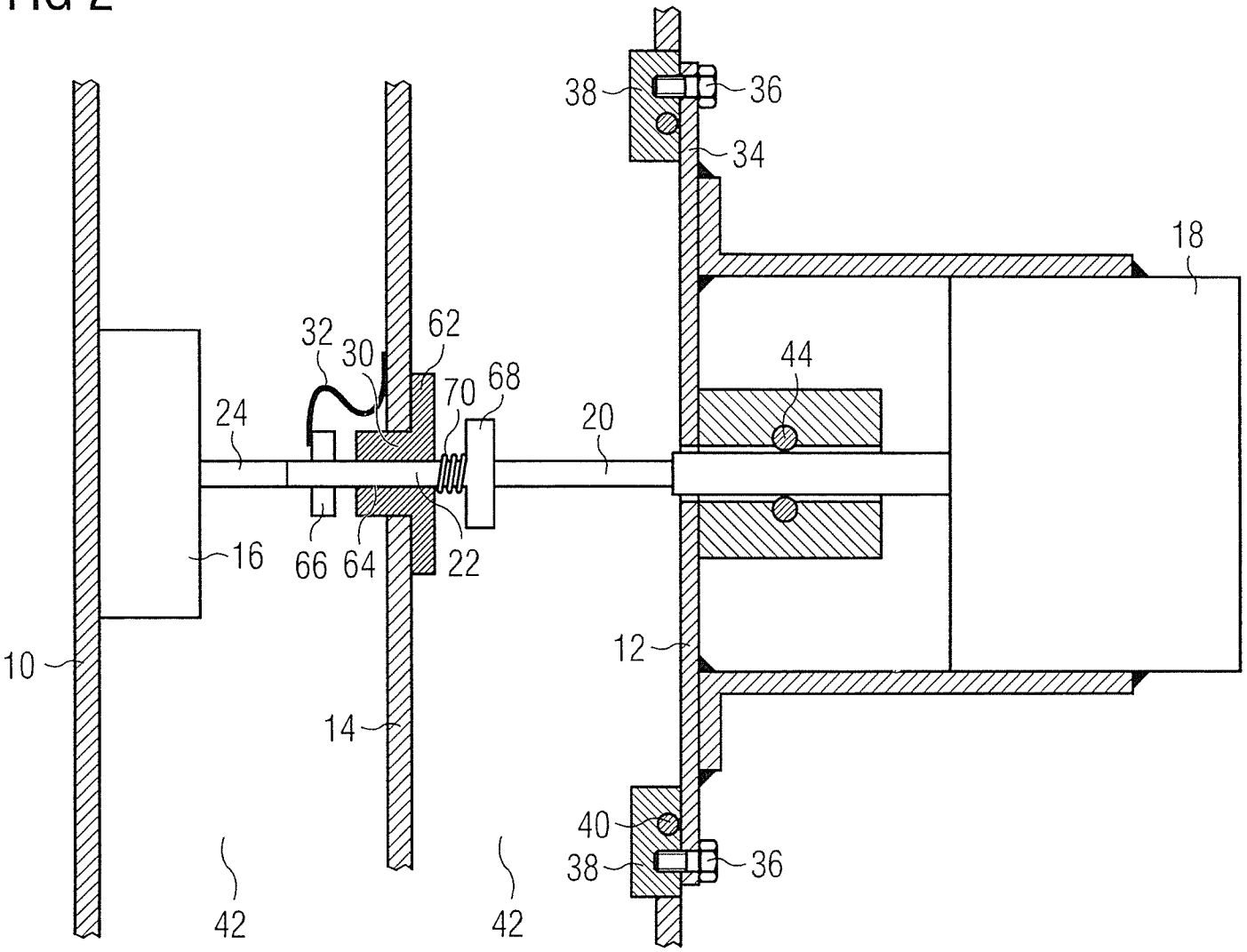
FIG. 2 schematically illustrates the same embodiment of the present invention in a first state.

FIG. 2 shows the arrangement of the embodiment of FIG. 1 in an "active" mode. Features corresponding to features shown in FIG. 1 carry corresponding reference labels. In this mode, actuator device 18 has caused first push-rod 20 to be displaced towards the device 16. First push-rod 20 has entered into contact with second push rod 22 and displaced it, against the mechanical bias provided by spring 70 or equivalent, into contact with actuator rod 24. First push-rod 20 has displaced second push-rod 22 sufficiently to apply pressure to the actuator rod 24, causing a change in status of the device 16, according to the type of device it is. Preferably, first push-rod 20, second push-rod 22 and actuator rod 24 are constructed of a material of low thermal conductivity, such as hollow resin-impregnated fiber glass tube. Second push-rod 22 should not have a clear bore through it, as that would allow thermal radiation from the OVC 12 to the cryogen vessel 10. Second push-rod 22 may be solid, or may have a bore which is closed off at one or both ends, or at another location along its length. In the "active" mode illustrated in FIG. 2, a solid thermal path exists between actuator device 18 and OVC 14 at ambient temperature and the device 16 attached to the cryogen vessel 10. By constructing first push-rod 20, second push-rod 22 and actuator 24 of material of low thermal conductivity, the transfer of heat from ambient temperature to cryogen vessel 10 is limited. At the end of the "active" mode, actuator device 18 retracts first push-rod 20 away from device 16, outwards of the OVC. The arrangement reverts to the "rest" mode shown in FIG. 1. The second push-rod 22 reverts to its biased rest position out of contact with both the first push-rod 20 and the actuator rod 24.

Although not illustrated in the drawings, it is conventional to provide solid insulation between the OVC 12 and the thermal radiation shield 14, for example in the form of multi-layered aluminised polyester sheets. Preferably, such solid insulation is provided around at least the second push-rod 22 to reduce any transmission of heat from the OVC to the cryogen vessel 10 by radiation through hole 30.

While the invention has been described above with reference to a limited number of specific embodiments, numerous modifications and variations are possible, and are provided by the present invention. Some of these modifications and variations are described below.

Figure 3:
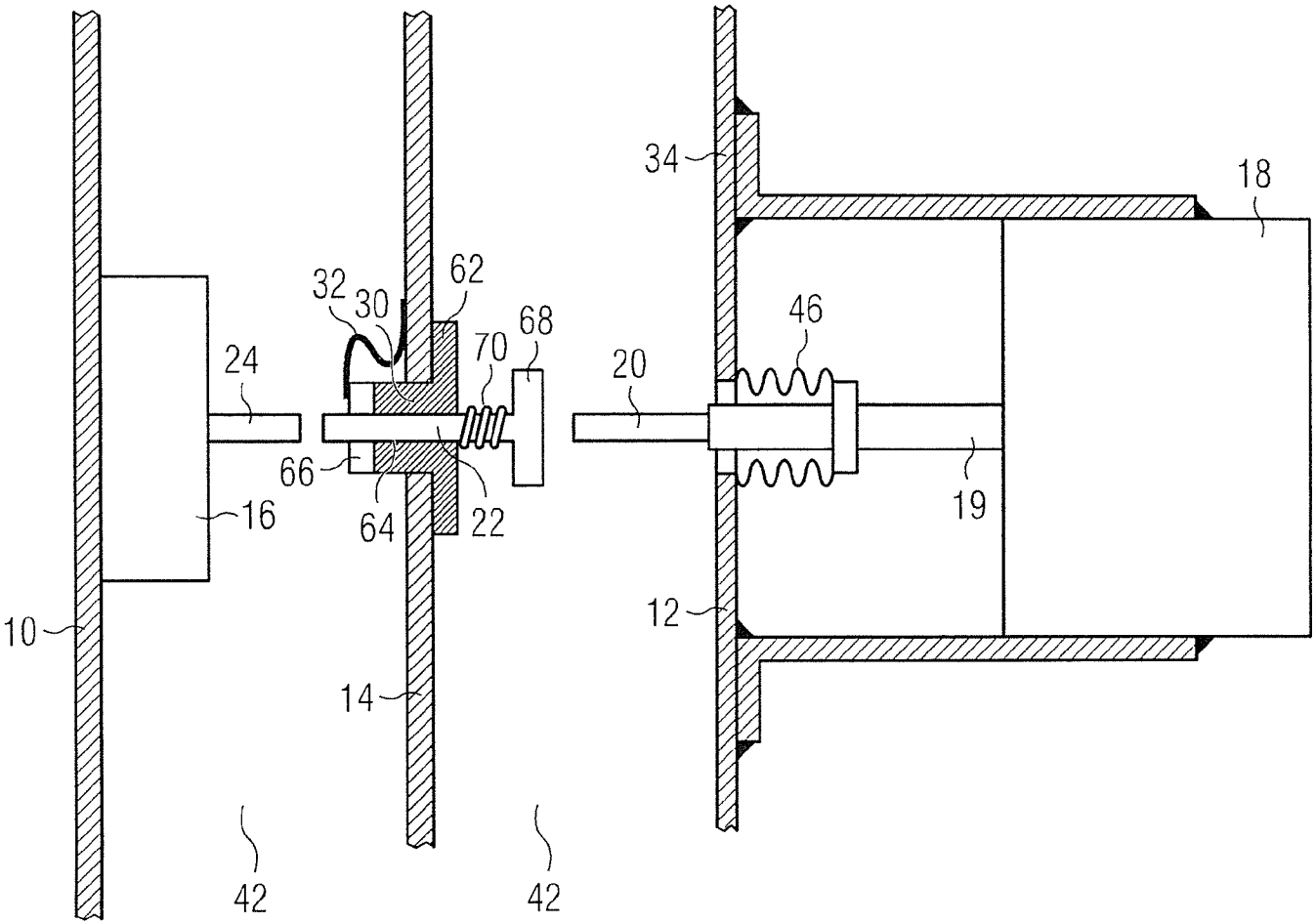
FIGS. 3-4 schematically illustrate further embodiments of the present invention.

FIG. 3 illustrates an actuation arrangement according to another embodiment of the present invention. Features corresponding to features shown in FIGS. 1 and 2 carry corresponding reference numerals.

The embodiment of FIG. 3 corresponds to the embodiment of FIG. 1 except in that output tube 19 of the actuator device 18 is sealed to the OVC 12 or access hatch 34 by a bellows 46 instead of the polymer seal 44 shown in FIGS. 1 and 2. Bellows 46 may be a stainless steel bellows brazed, soldered or welded to the OVC 14 or access hatch 34 and the output tube 19 of the actuator device 18. The bellows may alternatively be bonded by an appropriate adhesive or attached and sealed by any other appropriate arrangement. First push-rod 20 is driven through output tube 19 by actuator device 18 as described with reference to FIGS. 1 and 2. In an alternative arrangement, bellows 46 may be sealed to the first push-rod 20. In such case, output tube 19 may be omitted.

Figure 4:
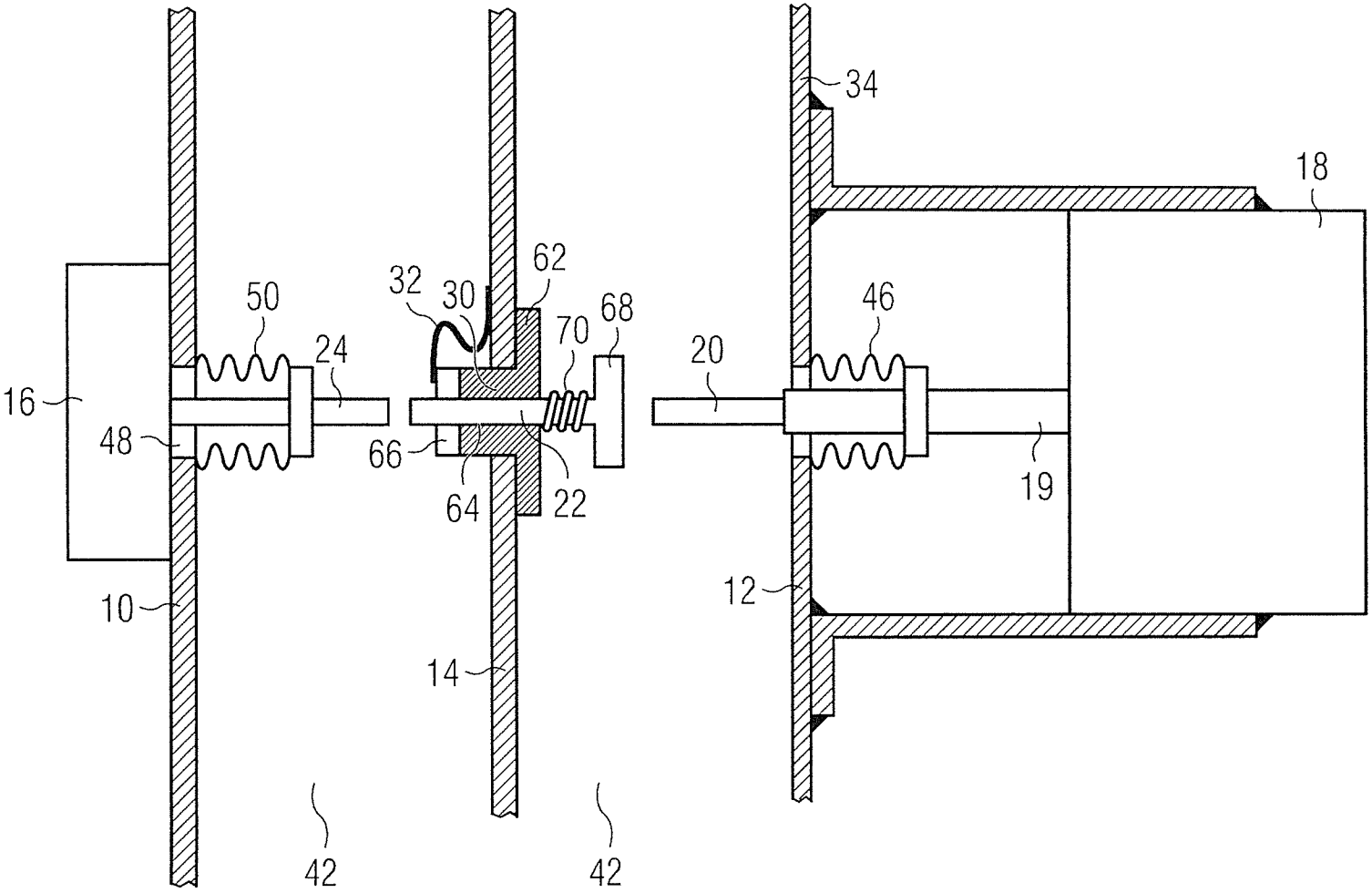

FIG. 4 illustrates an actuation arrangement according to another embodiment of the present invention. Features corresponding to features shown in FIGS. 1-3 carry corresponding reference numerals.

The embodiment of FIG. 4 corresponds to the embodiment of FIG. 3 except in that device 16 is mounted inside the cryogen vessel 10. Actuator rod 24 protrudes through a hole 48 in the cryogen vessel 10 and is sealed to the cryogen vessel by a bellows 50. Bellows 50 may be a stainless steel bellows brazed, soldered or welded to the cryogen vessel 10. The bellows may alternatively be bonded by an appropriate adhesive or attached and sealed by any other appropriate arrangement. Actuator rod 24 is driven by second push-rod 22 as described in relation to other embodiments, and bellows 50 is compressed or expands in response to force applied to the actuator rod 24 by second push-rod 22 and also to the difference in gas pressure between the interior of the cryogen vessel 10 and the vacuum region 42.

In various embodiments of the invention, the actuator device 18 may be operated electrically, hydraulically, pneumatically or manually, among others. The device 16 may be an electromechanical switch, a mechanical thermal linkage, or other electrical device, as examples.

Actuator device 18 may be located inside the OVC, but in that case it will be necessary to transmit commands or actuation force to the actuator device 18 through the wall of the OVC 12, so a suitable sealing arrangement would need to be provided.

By providing a mechanical linkage between actuator device 18 and device 16, the present invention allows a higher force to be applied to the device 16 than might be possible in the case of, for example, pneumatic or electrical actuation of actuator rod 24 of device 16.

By placing actuator device 18 on the outside of the OVC, or on a demountable access panel 34, replacement and servicing is simplified. In the case of demountable access panel 34, access to second push rod 22 is simplified. It would also be possible to mount second push rod 22 on a demountable access panel (not illustrated) in the thermal radiation shield 14, making it relatively easy to access device 16.

In the "rest" mode, as illustrated in FIG. 4, gaps between first push-rod 20, second push-rod 22 and actuator rod 24 limit thermal influx by conduction through the arrangement of the present invention. The second push-rod 22 is preferably thermally linked to the thermal radiation shield, and thermally stabilises at the temperature of the thermal radiation shield when in "rest" mode.

Other modifications and variations are also possible within the scope of the present invention as defined in the appended claims.

We claim as our invention:

1. A cryostat comprising:

a cryogen-cooled vessel contained inside of an OVC, with a thermal radiation shield also inside of the OVC that shields the cryogen-cooled vessel from radiant heat from the OVC, said cryogen-cooled vessel having an actuatable component attached thereto that requires application of a force thereto in order to actuate the actuatable component;

an actuator device attached to said OVC;

a first push rod that extends through said OVC so as to be movable toward and away from said thermal radiation shield;

a second push rod mounted at said thermal radiation shield so as to be movable toward and away from said actuatable component, and having a bias in a direction away from said actuatable component;

an actuator rod mounted to said actuatable component so as to protrude from said actuatable component into a space between said thermal radiation shield and said cryogen-cooled vessel;

said actuator device being operable to move said first push rod into mechanical engagement with said second push rod, to thereby move said second push rod, against said bias, into mechanical engagement with said actuator rod in order to thereby apply said force and actuate said actuatable component; and said actuator device being operable, after said actuatable device is actuated, to move said first push rod away from said second push rod, thereby causing said bias to separate said second push rod from said actuator rod.

2. A cryostat according to claim 1 wherein the second push-rod traverses the thermal radiation shield through a hole in the radiation shield, and wherein said assembly comprises a thermally conductive path between the second push-rod and the thermal radiation shield.

3. A cryostat according to claim 2 wherein the cryogenically-cooled device is attached to an exterior surface of the cryogen cooled vessel, and so an entirety of said actuator rod is in said space between said thermal radiation shield and said cryogen-cooled vessel.

4. A cryostat according to claim 2 comprising a mount for the second push-rod in said hole that comprises a mechanical bias element that produces said bias.

5. A cryostat according to claim 4 wherein said mount comprises solid insulation between the OVC and the thermal radiation shield, the solid insulation surrounding the second push-rod in said hole.

6. A cryostat according to claim 1 comprising a mount adapted to attach the actuator device to an exterior surface of the OVC.

7. A cryostat according to claim 1 wherein the actuator device is adapted to be mounted onto an access hatch forming part of the OVC.

8. A cryostat according to claim 1 comprising a polymer seal adapted to seal the first push-rod to the OVC.

9. A cryostat according to claim 1 wherein the actuator device comprises an output tube adapted to proceed through the OVC, and a polymer seal adapted to said seal the output tube to the OVC, said first push rod being movable in said output tube toward and away from said second push rod.

10. A cryostat according to claim 1 wherein the actuator device comprises an output tube adapted to proceed through the OVC, and a bellows adapted to said seal the output tube to the OVC, said first push rod being movable in said output tube toward and away from said second push rod.

11. A cryostat according to claim 1 wherein the actuatable component is mounted inside the cryogen-cooled vessel, and so the actuator rod is adapted to protrude through a hole in the cryogen-cooled vessel.

12. A cryostat according to claim 11 comprising a bellows surrounding the actuator rod adapted to seal the actuator rod to the cryogen vessel.

13. A cryostat according to claim 1 wherein the first push-rod, the second push-rod and the actuator rod are constructed of resin-impregnated fiber glass.

* * * * *